US007121761B2

(12) United States Patent
Woodruff

(10) Patent No.: US 7,121,761 B2
(45) Date of Patent: Oct. 17, 2006

(54) PAVED SURFACE CONFIGURED FOR REDUCING TIRE NOISE AND INCREASING TIRE TRACTION AND METHOD AND APPARATUS OF MANUFACTURING SAME

(76) Inventor: Paul N. Woodruff, 4817 Quail Point Rd., Salt Lake City, UT (US) 84124

( * ) Notice: Subject to any disclaimer, the term of this patent is extended or adjusted under 35 U.S.C. 154(b) by 0 days.

(21) Appl. No.: 10/856,670

(22) Filed: May 28, 2004

(65) Prior Publication Data

US 2004/0240937 A1 Dec. 2, 2004

Related U.S. Application Data

(60) Provisional application No. 60/473,528, filed on May 28, 2003.

(51) Int. Cl.
*E01C 11/00* (2006.01)
*E01C 23/02* (2006.01)

(52) U.S. Cl. ..... 404/17; 404/19; 404/93

(58) Field of Classification Search ..... 404/75, 404/93, 94, 17, 30, 96, 101, 103, 117–120, 404/19; 299/39.4
See application file for complete search history.

(56) References Cited

U.S. PATENT DOCUMENTS

| | | | | |
|---|---|---|---|---|
| 2,574,090 | A * | 11/1951 | Dofsen | 404/15 |
| 2,595,142 | A * | 4/1952 | Herck | 264/31 |
| 3,516,339 | A | 6/1970 | Perkins | |
| 3,595,143 | A | 7/1971 | Polselli | |
| 3,605,579 | A * | 9/1971 | Heltzel | 404/93 |
| 3,703,857 | A * | 11/1972 | MacKinnon | 404/93 |
| 3,801,211 | A * | 4/1974 | Perkins | 404/75 |
| 3,850,541 | A * | 11/1974 | Baillet et al. | 404/114 |
| 3,874,806 | A * | 4/1975 | Grist et al. | 404/93 |
| 3,910,738 | A * | 10/1975 | Chandler et al. | 425/162 |
| 4,318,631 | A * | 3/1982 | Vickers | 404/93 |
| 4,396,312 | A | 8/1983 | Nilsson | |
| 4,634,188 | A * | 1/1987 | Persson | 299/40.1 |
| 4,701,069 | A | 10/1987 | Whitney | |
| 4,744,694 | A * | 5/1988 | Leone | 404/89 |
| 4,759,658 | A * | 7/1988 | Manor | 404/93 |
| 4,764,051 | A | 8/1988 | Whitney | |
| 4,940,358 | A * | 7/1990 | Maletic | 404/93 |
| 5,176,426 | A * | 1/1993 | Adamson | 299/39.3 |

(Continued)

FOREIGN PATENT DOCUMENTS

EP 0 957 203 A2 11/1999

(Continued)

OTHER PUBLICATIONS

"Noise and Texture on PCC Pavements", author—David A Kuemmel et al.,*Final Report WI/SPR-08-99,* written for the Wisconsin Dept. of Transportation, Madison, WI, Jun. 2000.

(Continued)

*Primary Examiner*—Raymond W. Addie
(74) *Attorney, Agent, or Firm*—Morriss O'Bryant Compagni

(57) ABSTRACT

A paved surface configured for reducing tire noise and increasing tire traction on the paved surface and to a method and apparatus for manufacturing such a paved surface. The paved surface includes grooves in the traffic bearing surface that are substantially neither transverse nor parallel to the intended direction of traffic.

13 Claims, 10 Drawing Sheets

U.S. PATENT DOCUMENTS

| | | | | |
|---|---|---|---|---|
| 5,445,437 | A * | 8/1995 | Adamson | 299/39.3 |
| 5,502,941 | A * | 4/1996 | Zember et al. | 52/314 |
| 5,851,086 | A * | 12/1998 | Kurasako | 404/94 |
| 5,860,764 | A * | 1/1999 | Roberts | 404/93 |
| 6,099,080 | A * | 8/2000 | Hirashita et al. | 299/39.3 |
| 6,206,607 | B1 | 3/2001 | Medico, Jr. et al. | |
| 6,210,071 | B1 * | 4/2001 | McSharry | 404/94 |
| 6,382,871 | B1 * | 5/2002 | Ross | 404/75 |
| 6,497,531 | B1 * | 12/2002 | Sipherd et al. | 404/111 |

FOREIGN PATENT DOCUMENTS

| | | |
|---|---|---|
| EP | 1 052 333 A1 | 11/2000 |

OTHER PUBLICATIONS

"Designing Porous Road Surfaces to Reduce Traffic Noise", author—P.M. Nelson*TRL Annual Review 1994,* TRL Limited, United Kingdom.

* cited by examiner

PAVED SURFACE CONFIGURED FOR REDUCING TIRE NOISE AND INCREASING TIRE TRACTION AND METHOD AND APPARATUS OF MANUFACTURING SAME

CROSS-REFERENCE TO RELATED APPLICATIONS

This nonprovisional patent application claims benefit and priority under 35 U.S.C. § 119(e) of the filing of U.S. Provisional Patent Application Ser. No. 60/473,528 filed on May 28, 2003, titled "IMPROVED ROAD SURFACE".

BACKGROUND OF THE INVENTION

1. Field of the Invention

This invention relates generally to road pavement for vehicles. More particularly, the invention relates to a paved surface configured for reducing tire noise and increasing tire traction on the paved surface and to a method and apparatus for manufacturing such a paved surface.

2. Description of Related Art

Modern roads manufactured to transport vehicular traffic typically are made from asphalt or concrete. The use of concrete is generally preferred for sections of road that see sustained and heavy traffic loads. Stones are typically placed into the asphalt mix to form an interrupted raised structure having multiple channels for channeling water from underneath the footprint of a rolling tire. Additionally, the traffic carrying surface of a section of a concrete road may be intentionally roughened, or patterned, to facilitate displacement of water from under vehicle tires during wet conditions, thereby increasing traction.

A conventional method of creating a suitable rough top surface is to employ diamond coated saw blades to cut parallel grooves into a smoothly finished and cured concrete surface. Such grooves are typically oriented perpendicular (or transverse) to the direction of traffic and are generally spaced apart by about 1 inch or less. Alternatively, the parallel grooves may be disposed on concrete road surfaces in a generally longitudinal direction or parallel to the direction of traffic.

One problem associated with transversely oriented grooves is their interaction with vehicle tires in generating excessive and undesirable road noise. Residents living near roads having such transversely grooved concrete surfaces suffer from road noise generated by traffic on the road. Longitudinally oriented grooves inherently interact with front and rear tires of motorcycles causing an undesired road-imparting steering to the motorcycle. Thus, a motorcycle rider suffers from having excessive monitoring of the motorcycle steering to overcome the "squirrely" feeling induced by the longitudinal grooves.

Thus, it would be highly advantageous to provide a paved surface configured for reducing tire noise and increasing tire traction on the paved surface and to a method and apparatus for manufacturing such a paved surface. It would also be advantageous to avoid the problems associated with conventional transverse or longitudinally grooved road surfaces.

SUMMARY OF THE INVENTION

An embodiment of a paved surface having a longitudinal axis parallel to an intended traffic direction is disclosed. The paved surface may include a planar surface material having a traffic bearing surface and a plurality of grooves in the traffic bearing surface, each groove substantially parallel and spaced apart from adjacent grooves, each groove beginning at a first side of the paved surface and ending on an opposite side of the paved surface, wherein each groove is not in a substantially linear transverse orientation relative to the intended traffic direction.

An embodiment of a method of forming a traffic bearing surface in pavement is also disclosed. The method may include providing paving material in a substantially smooth state capable of receiving and maintaining an imprint and imprinting a plurality of grooves in the paving material, wherein each groove is substantially parallel and spaced apart from adjacent grooves, each groove beginning at a first side of the paved surface and ending on an opposite side of the paved surface, wherein each groove is not in a substantially linear transverse orientation relative to an intended traffic direction along the traffic bearing surface.

An embodiment of an apparatus for forming a traffic bearing surface in concrete uncured and capable of accepting and maintaining an imprint is disclosed. The apparatus may include a trolley supporting a plurality of tines, each tine configured for dragging along the uncured concrete to form a groove. The apparatus may further include a framework for supporting the trolley and configured for sweeping the trolley and plurality of tines across the uncured concrete to form a plurality of grooves, wherein each groove is substantially parallel and spaced apart from adjacent grooves, each groove beginning at a first side of the paved surface and ending on an opposite side of the paved surface, wherein each groove is not in a substantially linear transverse orientation relative to an intended traffic direction along the traffic bearing surface.

Additional features and advantages of the invention will be set forth in the description which follows, and in part will be apparent from the description, or may be learned by the practice of the present invention.

BRIEF DESCRIPTION OF THE DRAWINGS

The following drawings illustrate exemplary embodiments for carrying out the invention. Like reference numerals refer to like parts in different views or embodiments of the present invention in the drawings.

DETAILED DESCRIPTION

Figure 1:
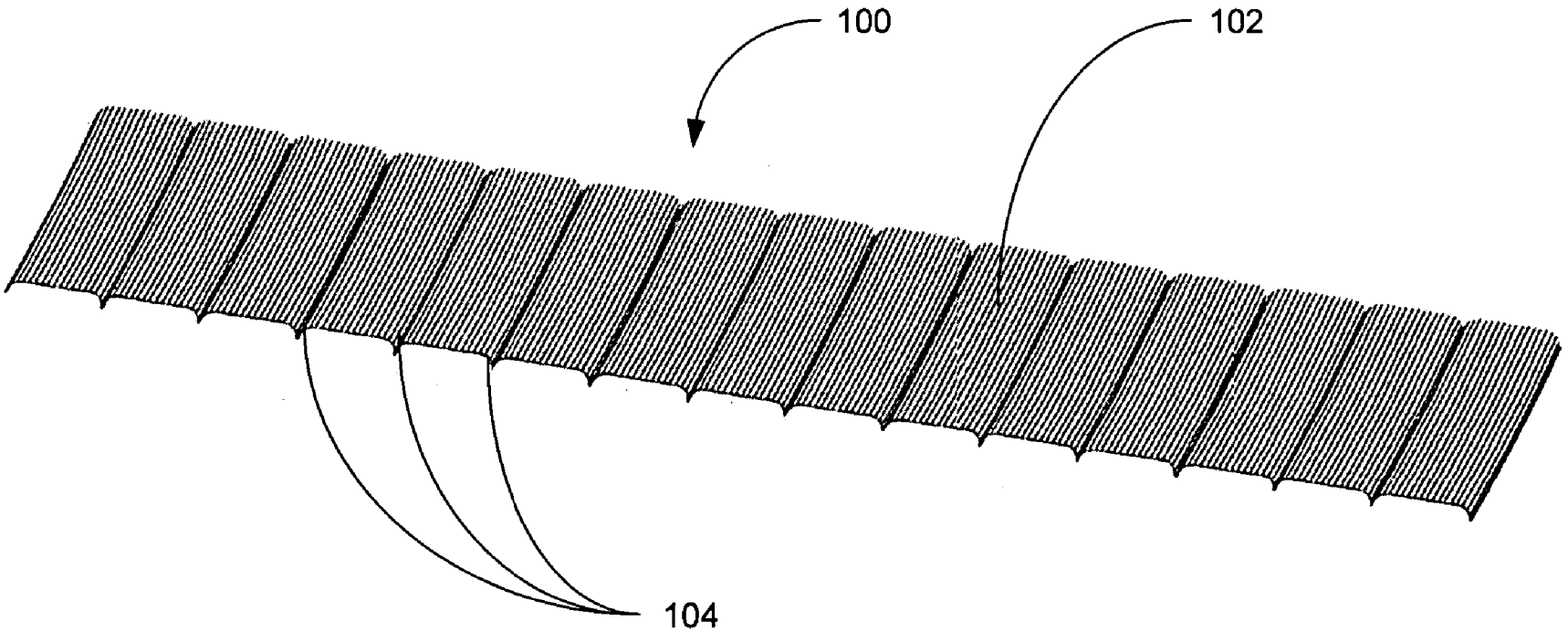
FIG. 1 is a perspective view of a cross-section of an embodiment of a traffic bearing surface formed on a paved surface in accordance with the present invention.

FIG. 1 is a perspective view of a cross-section 100 of an embodiment of a traffic bearing surface 102 formed on a pavement or paved surface (not shown underneath for clarity of viewing) in accordance with the present invention. The embodiment of a traffic bearing surface 102 is configured for reducing tire noise and increasing tire traction in accordance with the present invention. The traffic bearing surface 102 may include a plurality of grooves 104 formed in the traffic bearing surface 102. The cross-section of the grooves 104 is not critical to the invention and may be configured of any suitable shape, e.g., V, curved V, U, square, rectangular and the like.

Another embodiment of the present invention is a paved surface having a longitudinal axis parallel to an intended traffic direction. The paved surface may include a planar surface material having a traffic bearing surface 102. The planar surface material may be of any suitable paving material, for example and not by way of limitation, concrete or asphalt. The embodiment of a paved surface may also include a plurality of grooves 104 in the traffic bearing surface, each groove substantially parallel and spaced apart from adjacent grooves, each groove beginning at a first side of the paved surface and ending on an opposite side of the paved surface, wherein each groove is not in a substantially linear transverse orientation relative to the intended traffic direction.

Figure 2:
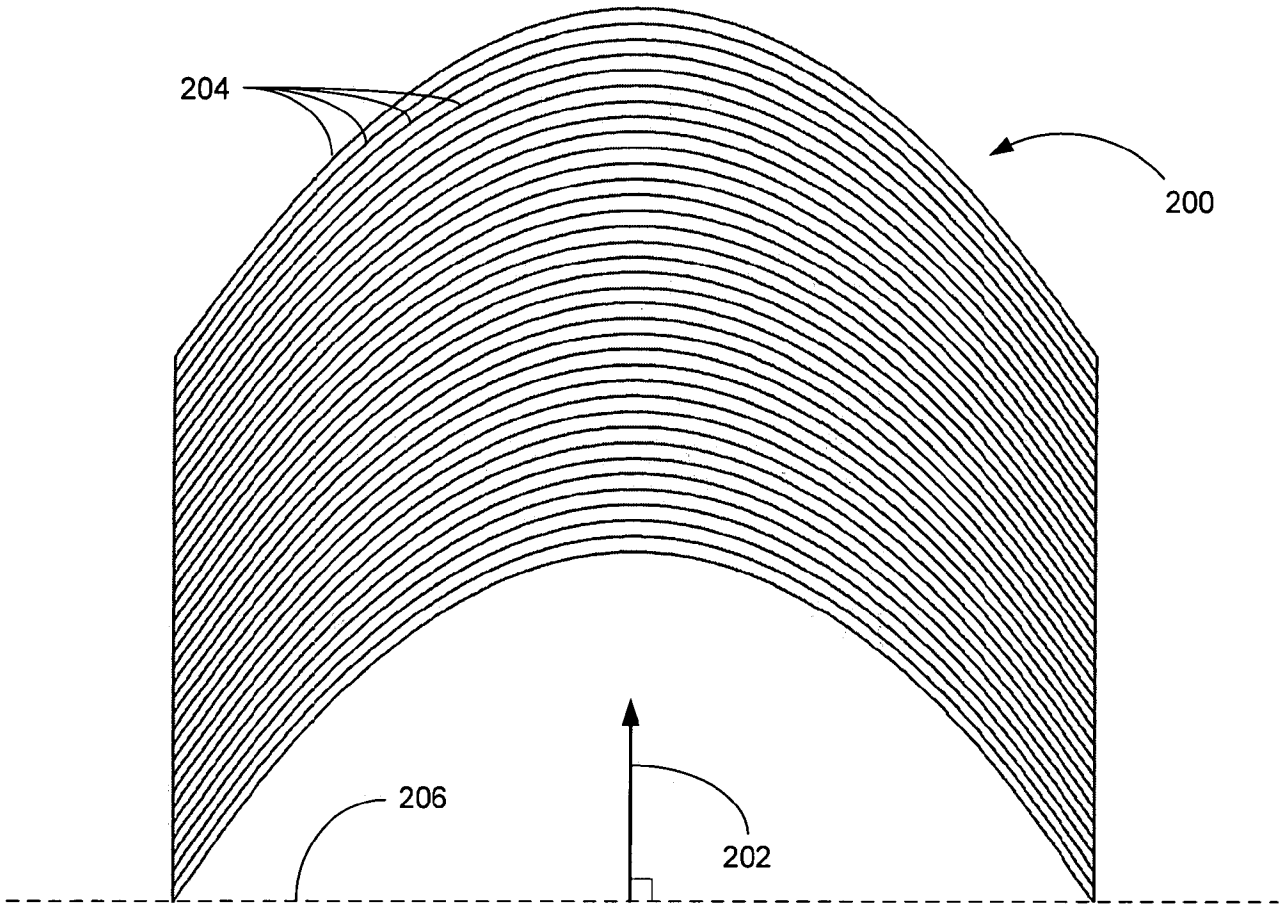
FIG. 2 illustrates a plurality of grooves arranged in a repeating parabolic curve pattern according to an embodiment of the present invention.
Figure 3:
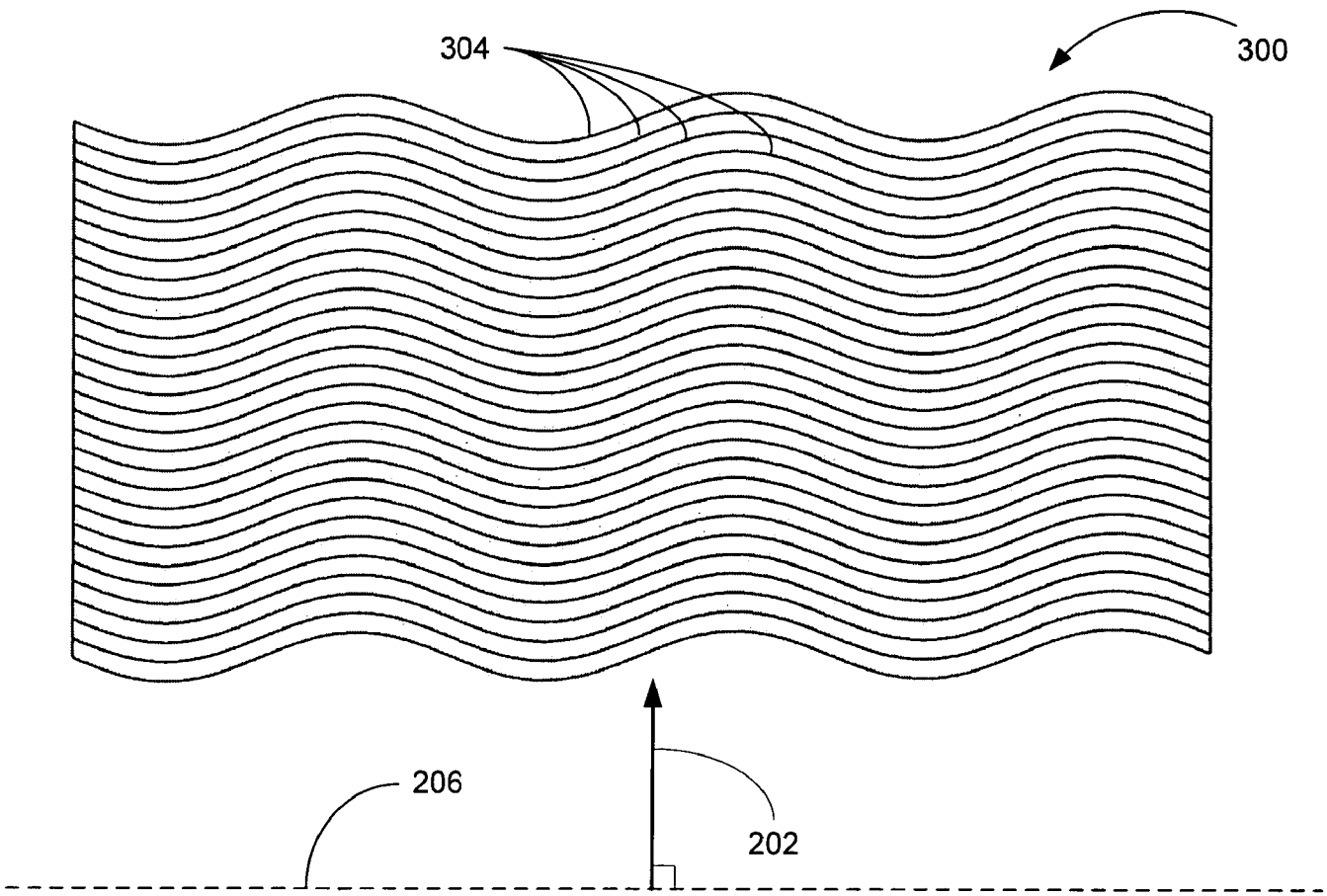
FIG. 3 illustrates a plurality of grooves arranged in a repeating sinusoidal curve pattern according to an embodiment of the present invention.
Figure 4:
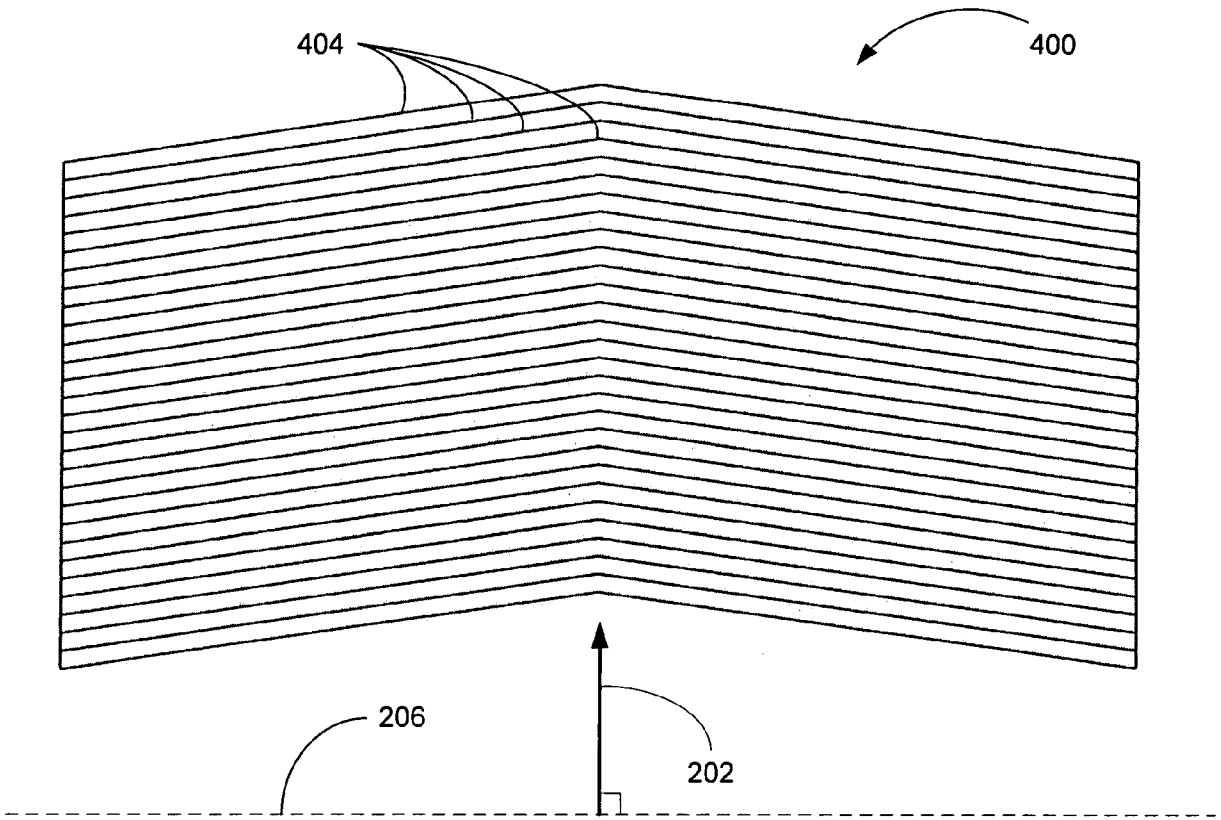
FIG. 4 illustrates a plurality of grooves arranged in a repeating bi-linear curve pattern according to an embodiment of the present invention.
Figure 5:
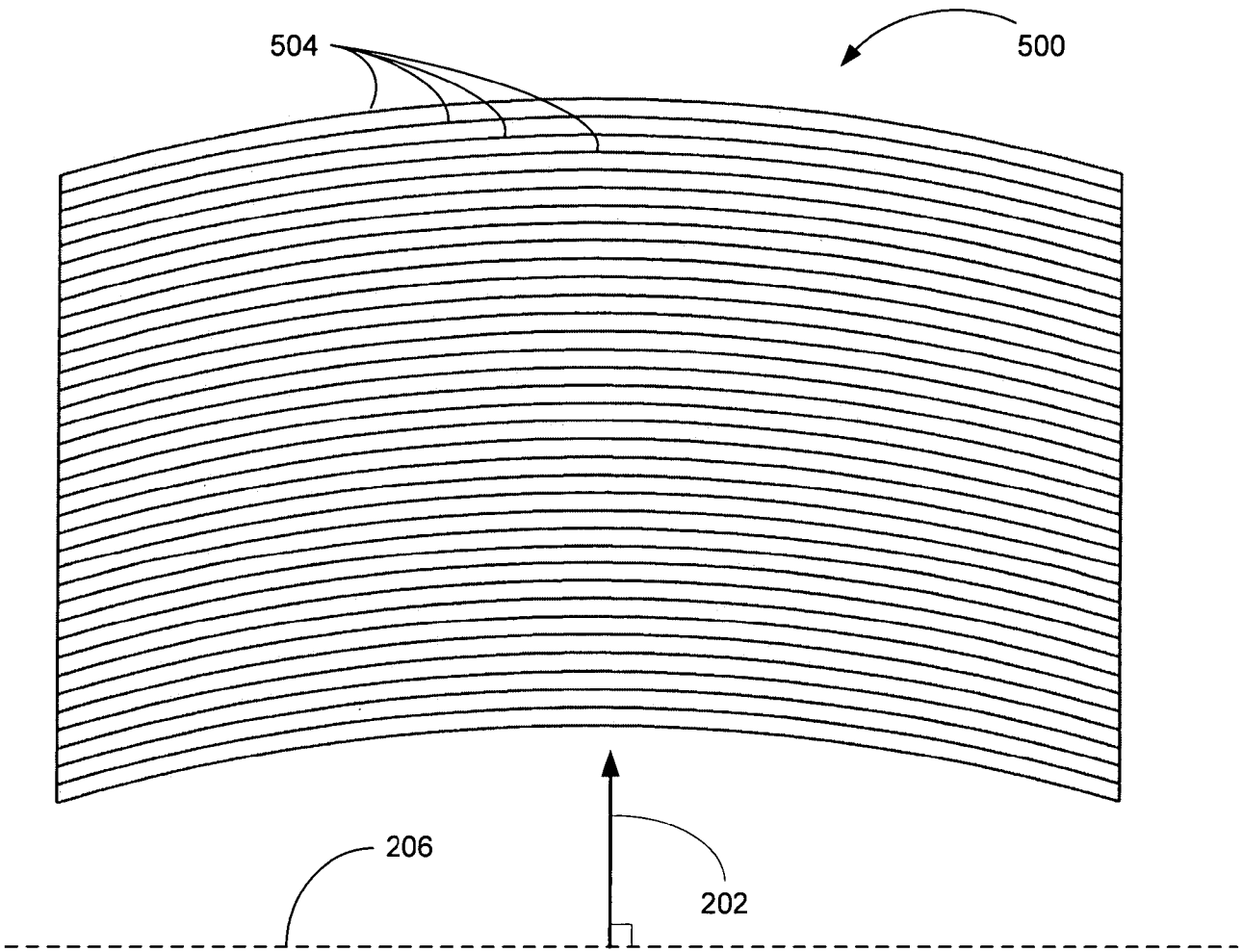
FIG. 5 illustrates a plurality of grooves arranged in a repeating arcuate curve pattern according to an embodiment of the present invention.
Figure 6:
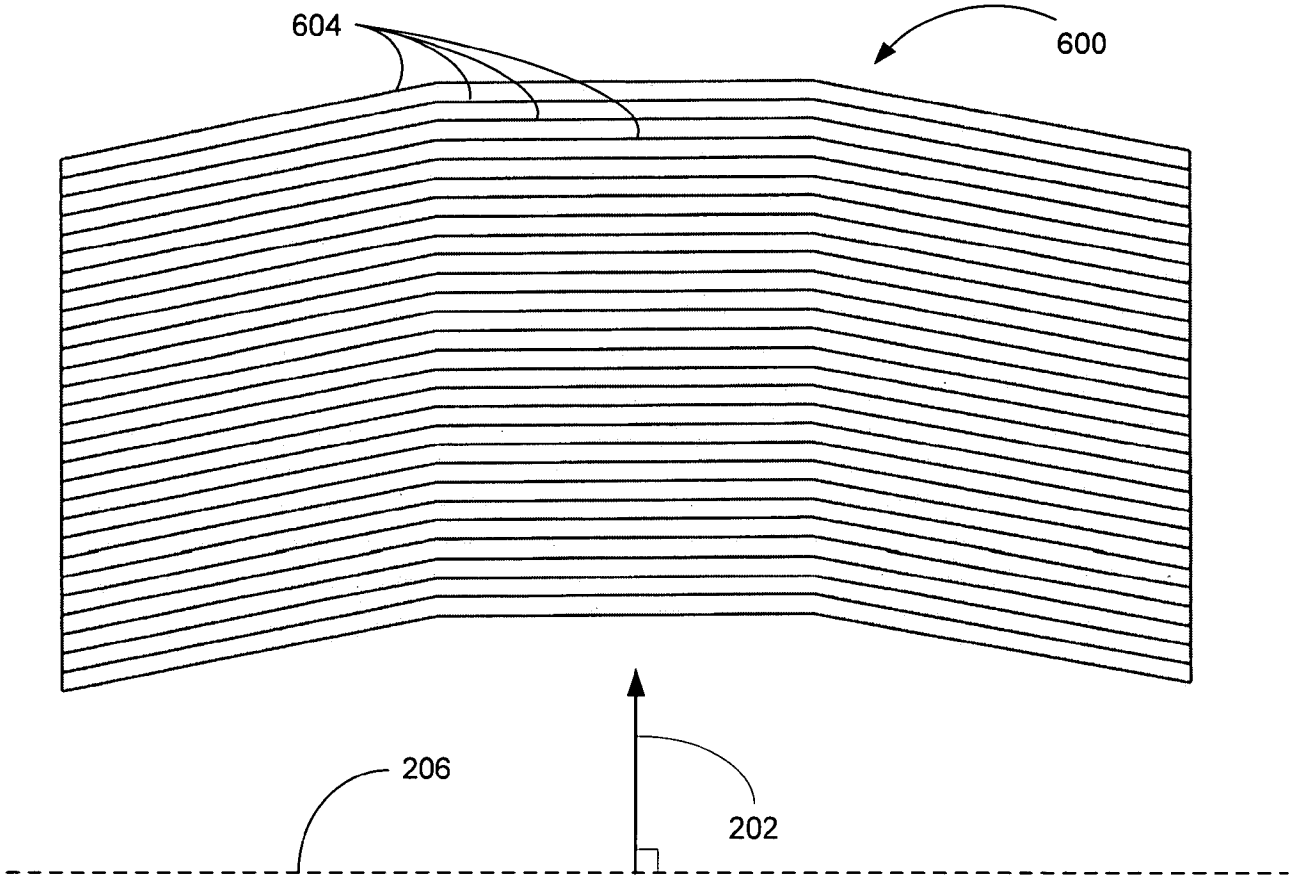
FIG. 6 illustrates a plurality of grooves arranged in a repeating multi-linear curve pattern according to an embodiment of the present invention.
Figure 7:
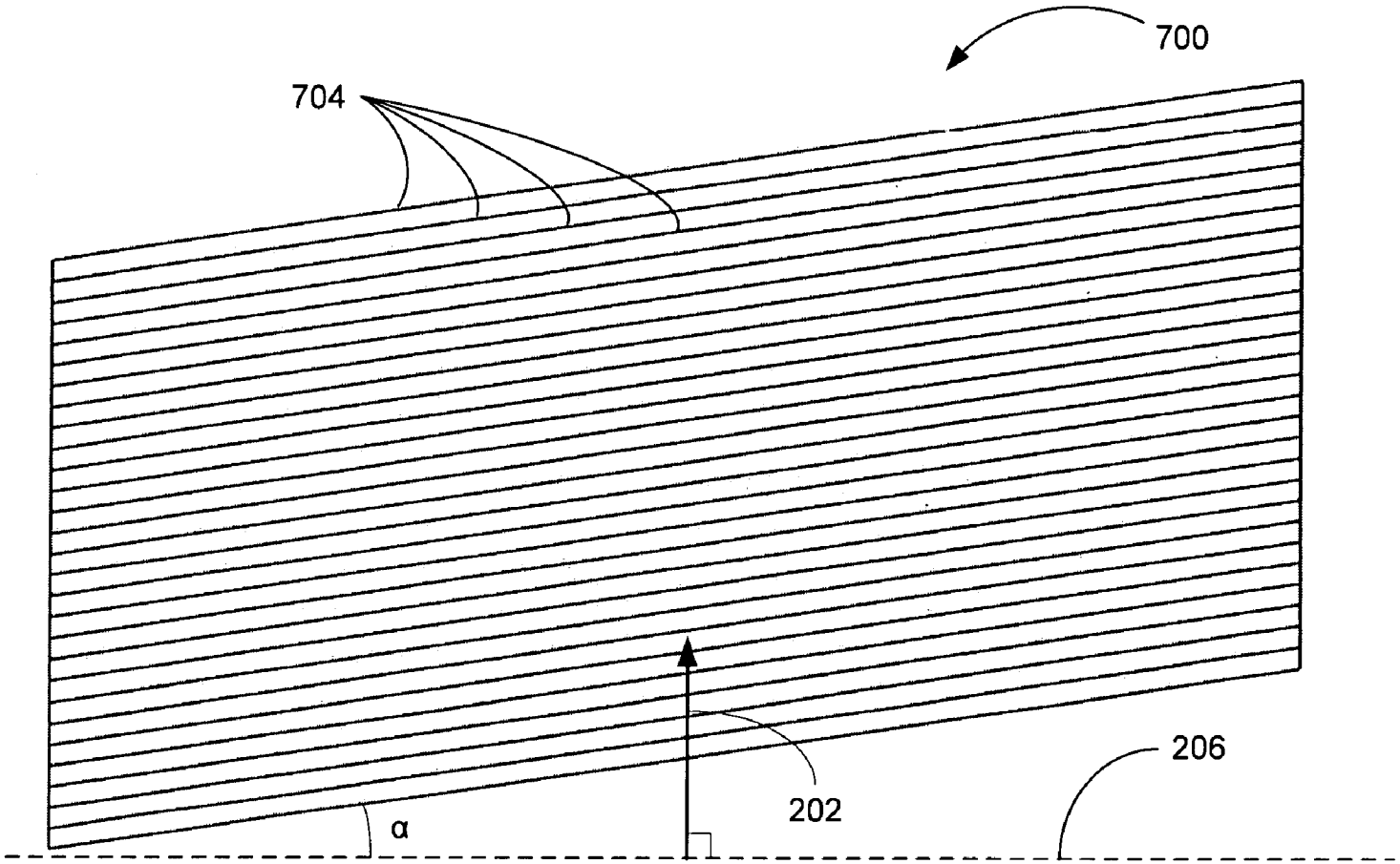
FIG. 7 illustrates a plurality of grooves arranged in a repeating a preselected angle linear curve pattern according to an embodiment of the present invention.

According to various embodiments of the present invention, each of the plurality of grooves may form a curve in the traffic bearing surface 102, for example and not by way of limitation, a parabolic curve, see FIG. 2, a sinusoidal curve, see FIG. 3, a bi-linear curve, see FIG. 4, an arcuate curve, see FIG. 5, a multi-linear curve, see FIG. 6, a preselected angle linear curve, see FIG. 7, an arbitrary convex curve or an arbitrary concave curve. According to another embodiment of the present invention, the plurality of grooves may form a cross-hatched pattern, see FIG. 8.

Referring to FIG. 2, a plurality of parabolic grooves 204 arranged in a parabolic curve pattern 200 according to an embodiment of the present invention is shown. The parabolic pattern 200 includes a plurality of parabolic grooves 204, wherein each parabolic groove 204 is substantially parallel and spaced apart from adjacent parabolic grooves 204. The intended traffic direction 202 is also shown in an arrow in FIG. 2. Of course the intended traffic direction 202 may be in the opposite direction according to another embodiment of the present invention. An imaginary line 206 is also shown traversing the width of the parabolic curve pattern 200 in the traffic bearing surface of pavement according to the present invention.

FIG. 3 illustrates a plurality of grooves arranged in a repeating sinusoidal curve pattern 300 according to an embodiment of the present invention. Each individual sinusoidal groove 304 is substantially parallel and spaced apart from adjacent sinusoidal grooves 304. FIG. 3 also shows an intended traffic direction 202 (arrow in FIG. 3) shown perpendicular to an imaginary line 206 which is shown traversing the width of the sinusoidal curve pattern 300 in the traffic bearing surface of pavement according to this embodiment of the present invention. Again, the intended traffic direction 202 may be in the opposite direction according to still another embodiment of the present invention.

FIG. 4 illustrates a plurality of grooves arranged in a repeating bi-linear curve pattern 400 according to another embodiment of the present invention. Each individual bi-linear groove 404 is substantially parallel and spaced apart from adjacent bi-linear grooves 404. FIG. 4 also shows an intended traffic direction 202 (arrow in FIG. 4) shown perpendicular to an imaginary line 206 which is shown traversing the width of the bi-linear curve pattern 400 in the traffic bearing surface of pavement according to this embodiment of the present invention. As with other illustrated embodiments, the intended traffic direction 202 may be in the opposite direction according to still another embodiment of the present invention.

FIG. 5 illustrates a plurality of grooves arranged in a repeating arcuate curve pattern 500 according to another embodiment of the present invention. Each individual arcuate groove 504 is substantially parallel and spaced apart from adjacent arcuate grooves 504. FIG. 5 also shows an intended traffic direction 202 (arrow in FIG. 5) shown perpendicular to an imaginary line 206 which is shown traversing the width of the arcuate curve pattern 500 in the traffic bearing surface of pavement according to this embodiment of the present invention. As with other illustrated embodiments, the intended traffic direction 202 may be in the opposite direction according to still another embodiment of the present invention.

FIG. 6 illustrates a plurality of grooves arranged in a repeating multi-linear curve pattern 600 according to another embodiment of the present invention. The multi-linear curve pattern 600 shown in FIG. 6 is tri-linear, but any suitable number of linear segments may be linked together of arbitrary lengths according to embodiments of the present invention. Each individual multi-linear groove 604 is substantially parallel and spaced apart from adjacent multi-linear grooves 604. FIG. 6 also shows an intended traffic direction 202 (arrow in FIG. 6) shown perpendicular to an imaginary line 206 which is shown traversing the width of the multi-linear curve pattern 600 in the traffic bearing surface of pavement according to this embodiment of the present invention. As with other illustrated embodiments, the intended traffic direction 202 may be in the opposite direction according to still another embodiment of the present invention.

According to other embodiments of a paved surface consistent with the present invention, each of the plurality of grooves 104 may further begin and end on an imaginary line 206 traversing the paved surface (shown in dashed line in FIGS. 2–6) in a direction perpendicular to the intended traffic direction 202.

According to yet another embodiment of a paved surface consistent with the present invention, each of the plurality of grooves 104 may further form parallel lines, each parallel line forming a preselected angle relative to an imaginary transverse line running perpendicular to the longitudinal axis. Referring to FIG. 7, a repeating preselected angle linear pattern 700 of linear grooves 704 is shown, consistent with an embodiment of the present invention. The preselected angle, $\alpha$, measured from an imaginary line 206 traversing the paved surface (shown in dashed line in FIG. 7) may range from about 3° to less than about 75°.

The minimum preselected angle, $\alpha$, that grooves may be inclined from the imaginary line 206 perpendicular to the intended traffic direction 202 may be determined empirically from an number of factors. Two of these factors are tire width and groove spacing. For example, with a 0.8 inch groove spacing (distance between grooves) and a typical truck tire, the minimum preselected angle, α, may be about 3°. For a typical small car tire a minimum preselected angle, α, may be about 6°. The advantage of introducing some preselected angle, α, in the grooves relative to a purely transverse set of grooves is that harmonic road noise from the leading edge of the footprint of tires hitting the next groove is reduced, yet still retaining the added traction of grooves versus a smooth surface. The preselected angle, α, may be inherent and variable as measured from a tangent in the curves illustrated in FIGS. 2, 3 and 5.

Figure 8:
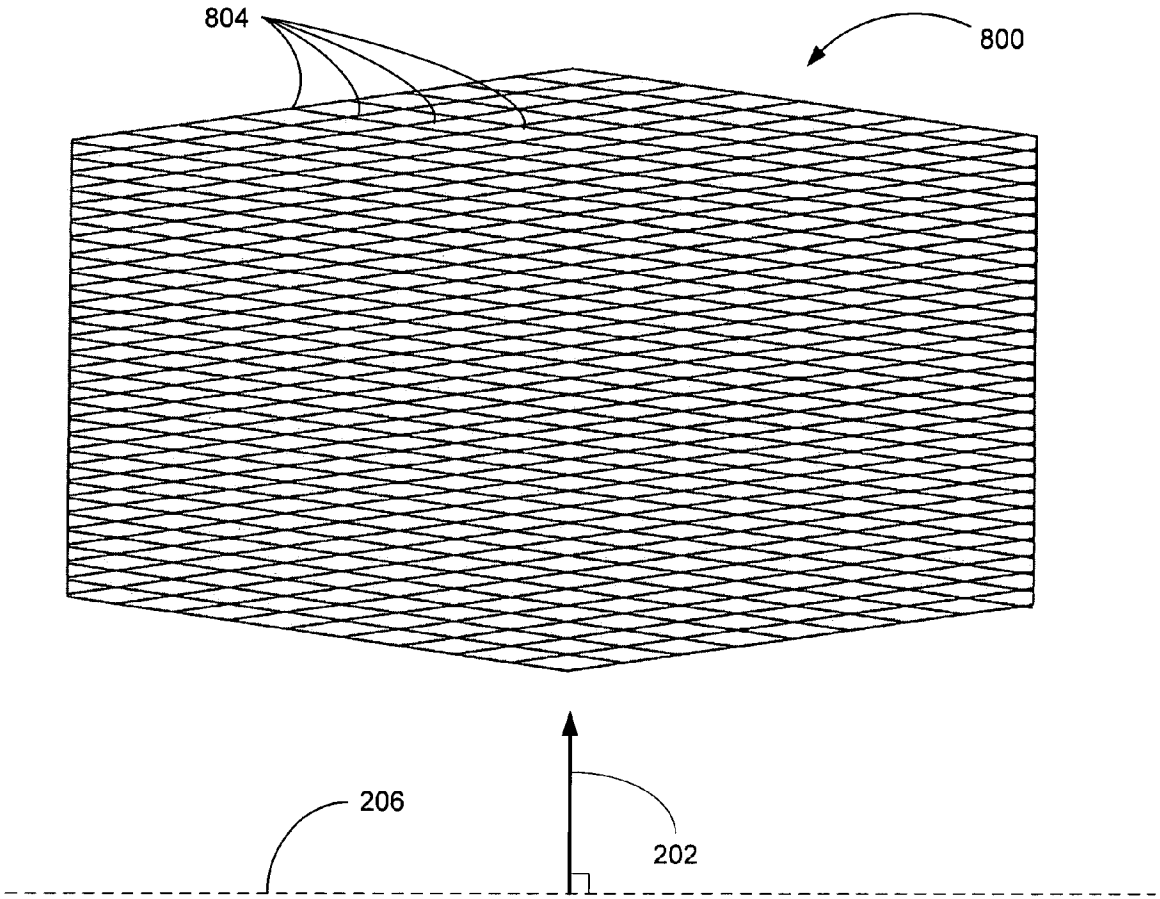
FIG. 8 illustrates a plurality of grooves arranged in a repeating cross-hatched pattern according to an embodiment of the present invention.

FIG. 8 illustrates a plurality of linear grooves 804 arranged in a repeating cross-hatched pattern 800 according to another embodiment of the present invention. The cross-hatched pattern 800 shown in FIG. 8 may be formed or mirrored preselected angle linear patterns 700 according to embodiments of the present invention. Each individual linear groove 804 in a given half of a mirrored, preselected angle linear pattern 700 is substantially parallel and spaced apart from adjacent linear grooves 804. FIG. 8 also shows an intended traffic direction 202 (arrow in FIG. 8) shown perpendicular to an imaginary line 206 which is shown traversing the width of the cross-hatched pattern 800 in the traffic bearing surface of pavement according to this embodiment of the present invention. As with other illustrated embodiments, the intended traffic direction 202 may be in the opposite direction according to still another embodiment of the present invention.

The particular spacing of the grooves in the various embodiments described above is not critical to the invention. The various embodiment described above may be applied to a variety of paving surface materials, for example and not by way of limitation, concrete, asphalt and any other suitable paving surface material.

Figure 9:
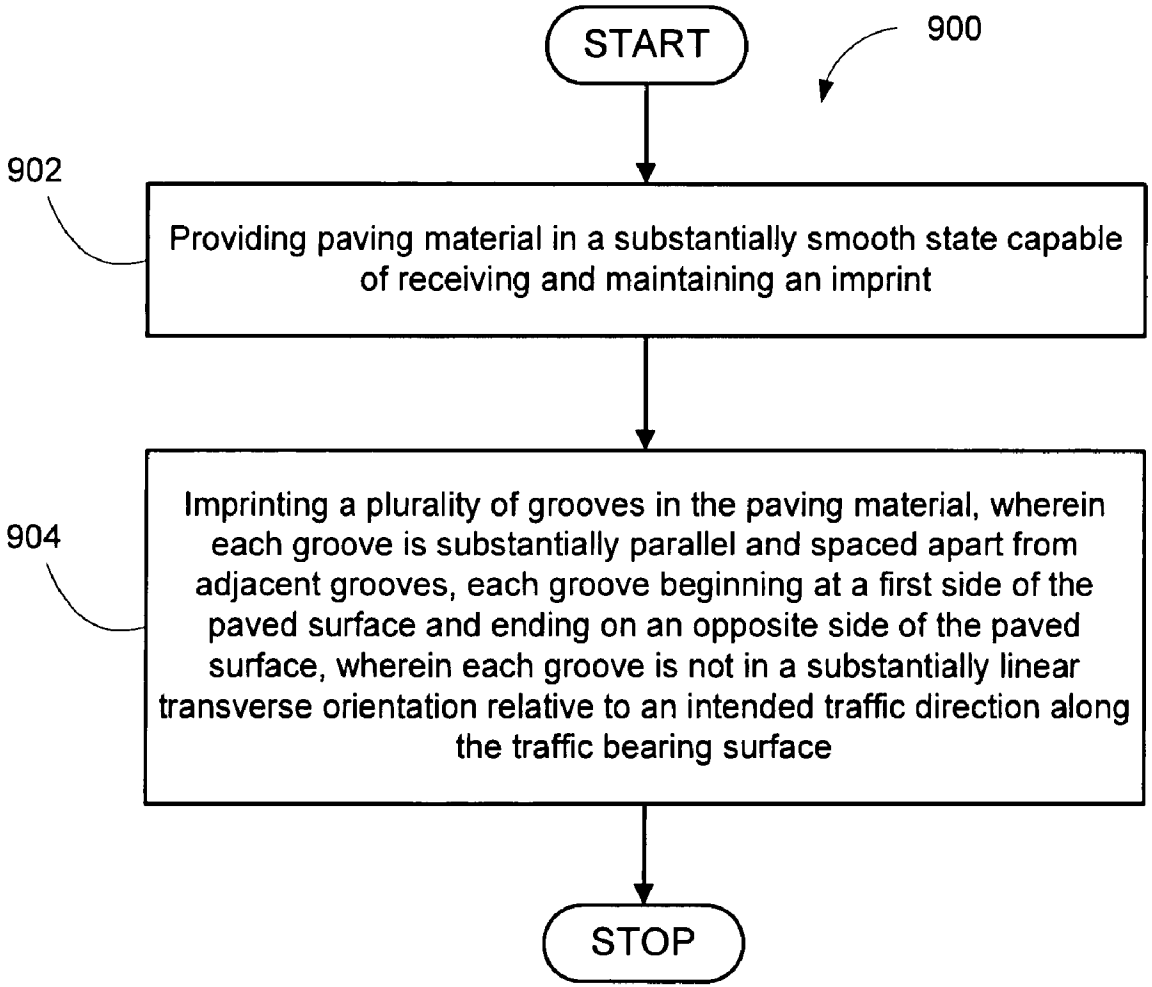
FIG. 9 is a flow chart of an embodiment of a method 900 of forming a traffic bearing surface in pavement according to the present invention.

FIG. 9 is a flow chart of an embodiment of a method 900 of forming a traffic bearing surface in pavement according to the present invention. Method 900 may include providing 902 paving material in a substantially smooth state capable of receiving and maintaining an imprint. Method 900 may further include imprinting 904 a plurality of grooves in the paving material, wherein each groove is substantially parallel and spaced apart from adjacent grooves, each groove beginning at a first side of the paved surface and ending on an opposite side of the paved surface, wherein each groove is not in a substantially linear transverse orientation relative to an intended traffic direction along the traffic bearing surface.

According to another embodiment of method 900, providing 902 paving material may include pouring concrete to form a substantially planar surface of uncured concrete. According to yet another embodiment, method 900 may further include curing the concrete to form the traffic bearing surface in the pavement.

According to still another embodiment of method 900, imprinting 904 a plurality of grooves may comprise dragging a plurality of tines across the substantially smooth uncured concrete wherein each tine forms a groove in the traffic bearing surface.

According to another embodiment of method 900, providing 902 paving material may include providing a substantially planar surface of cured concrete. According to still another embodiment of method 900, imprinting 904 a plurality of grooves may include cutting each of the plurality of grooves with a diamond tipped saw blade.

Figure 10:
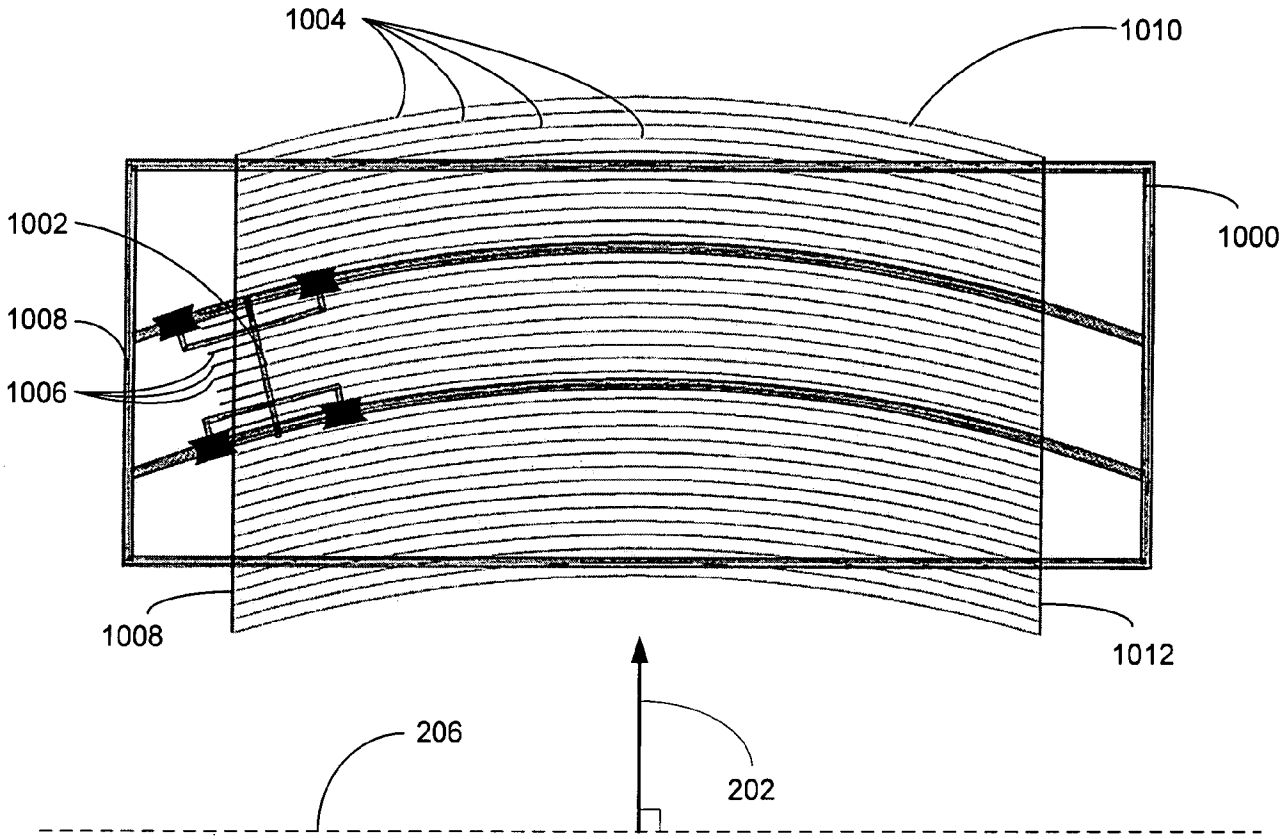
FIG. 10 is a schematic diagram of an apparatus 1000 for forming a traffic bearing surface in uncured concrete according to an embodiment of the present invention.

FIG. 10 is a schematic diagram of an apparatus 1000 for forming a traffic bearing surface in concrete uncured and capable of accepting and maintaining an imprint. Apparatus 1000 may include a trolley 1002 supporting a plurality of tines 1006, each tine configured for dragging along the uncured concrete to form a groove 1004. Apparatus 1000 may further include a framework 1008 for supporting the trolley 1002 and configured for sweeping the trolley 1002 and plurality of tines 1006 across the uncured concrete to form a plurality of grooves 1004, wherein each groove 1004 is substantially parallel and spaced apart from adjacent grooves 1004, each groove 1004 beginning at a first side 1008 of the paved surface 1010 and ending on an opposite side 1012 of the paved surface 1010, wherein each groove 1004 is not in a substantially linear transverse orientation relative to an intended traffic direction 206 along the traffic bearing surface. According to additional embodiments according to the present invention, each of the plurality of grooves may form a curve selected from a group consisting of: parabolic, sinusoidal, bi-linear, arcuate multi-linear, preselected angle linear, cross-hatched convex and concave.

The apparatus 1000 described above is merely exemplary and not intended to limit the scope of the present invention. One skilled in the art and in possession of this disclosure may find many other suitable systems and machines for manufacturing the paved surfaces disclosed herein. For example and not by way of limitation, the principles disclosed herein could be practiced using a robotic arm, a roller, a sled and by other apparatuses used for imprinting surfaces.

While the foregoing advantages of the present invention are manifested in the detailed description and illustrated embodiments of the invention, a variety of changes can be made to the configuration, design and construction of the invention to achieve those advantages. Hence, reference herein to specific details of the structure and function of the present invention is by way of example only and not by way of limitation.

What is claimed is:

1. A paved surface having a longitudinal axis parallel to an intended traffic direction, comprising:

a planar surface material comprising nonbituminous concrete having a curable traffic bearing surface; and a plurality of nonintersecting grooves formed using tines dragged by a trolley supported by a stationary framework in the traffic bearing surface prior to curing of the planar surface material, each groove substantially parallel and spaced apart from adjacent grooves, each groove beginning at a first side of the paved surface and ending on an opposite side of the paved surface, wherein each groove is not in a substantially linear transverse orientation relative to the intended traffic direction and wherein each groove forms a curve comprising a single maxima or minima between lane boundaries of the paved surface when viewed from above.

2. The paved surface according to claim 1, wherein each of the plurality of grooves forms a parabolic curve.

3. The paved surface according to claim 1, wherein each of the plurality of grooves forms a bi-linear curve.

4. The paved surface according to claim 1, wherein each of the plurality of grooves forms an arcuate curve.

5. The paved surface according to claim 1, wherein each of the plurality of grooves forms a convex curve.

6. The paved surface according to claim 1, wherein each of the plurality of grooves forms a concave curve.

7. The paved surface according to claim 1, wherein each of the plurality of grooves begin and end on an imaginary line traversing the paved surface in a direction perpendicular to the intended traffic direction.

8. A method of forming a traffic bearing surface in pavement, comprising:

providing paving material comprising nonbituminous concrete in a substantially smooth and uncured state capable of receiving and maintaining an imprint;

providing a framework for supporting a trolley having tines, the framework configured to remain stationary while allowing the trolley to sweep the tines across the surface of the uncured paving material; and imprinting a plurality of nonintersecting grooves in the paving material using the tines, wherein each groove is substantially parallel and spaced apart from adjacent grooves, each groove beginning at a first side of the paved surface and ending on an opposite side of the paved surface, wherein each groove is not in a substantially linear transverse orientation relative to an intended traffic direction along the traffic bearing surface, wherein each of the plurality of grooves forms a curve selected from a group consisting of: parabolic, bi-linear, arcuate, convex and concave, wherein each curve comprises a single maxima or minima between lane boundaries of the paved surface when viewed from above.

9. The method according to claim 8, wherein providing paving material comprises pouring concrete to form a substantially planar surface of uncured concrete.

10. The method according to claim 9, further comprising curing the concrete to form the traffic bearing surface in the pavement.

11. The method according to claim 9, wherein imprinting a plurality of grooves comprises dragging a plurality of tines across the substantially smooth uncured concrete wherein each tine forms a groove in the traffic bearing surface.

12. A paved surface formed according to the method of claim 8.

13. An apparatus for forming a traffic bearing surface in nonbituminous concrete, uncured and capable of accepting and maintaining an imprint, comprising:

a trolley supporting a plurality of tines, each tine configured for dragging along the uncured concrete to form a groove;

a framework for supporting the trolley and configured for sweeping the trolley and plurality of tines across the uncured concrete to form a plurality of grooves, wherein each groove is substantially parallel and spaced apart from adjacent grooves, each groove beginning at a first side of the paved surface and ending on an opposite side of the paved surface, wherein each groove is not in a substantially linear transverse orientation relative to an intended traffic direction along the traffic bearing surface;

wherein the framework is configured to remain stationary between sweeps of the trolley; and wherein each of the plurality of grooves forms a curve selected from a group consisting of: parabolic, bi-linear, arcuate, convex and concave, wherein each curve comprises a single maxima or minima between lane boundaries of the paved surface when viewed from above.

* * * * *